US005271607A

United States Patent [19]

Kubota et al.

[11] Patent Number: 5,271,607

[45] Date of Patent: Dec. 21, 1993

[54] BEARING STRUCTURE FOR HOIST/TRACTION APPARATUS

[76] Inventors: Haruo Kubota; Yoshio Nishi, both of c/o Elephant Chain Block Co., Ltd. of 180, 2-chome, Iwamuro, Osaka-Sayama-shi, Osaka Prefecture, Japan

[21] Appl. No.: 806,215

[22] Filed: Dec. 13, 1991

[51] Int. Cl.[5] ..... B66D 1/14; B66D 1/00

[52] U.S. Cl. ..... 254/342; 384/438; 384/441

[58] Field of Search ..... 254/357, 346, 352, 372, 254/903, 342, 353; 384/438, 441

[56] References Cited

U.S. PATENT DOCUMENTS 3,727,887 4/1973 Lytle ..... 254/903 X 4,023,744 5/1977 Shutt ..... 254/903 X

*Primary Examiner*—Andrew M. Falik

[57] ABSTRACT

A hoist/traction apparatus including a gear cover for covering a gear reduction mechanism. The gear cover includes swollen portions protruding outwardly and having blind holding portions open inwardly so as to receive axial ends of intermediate shafts and a driving shaft of the hoist/traction apparatus. In addition, the gear cover is provided with a reinforcing rib to protect the swollen portions.

7 Claims, 3 Drawing Sheets

BEARING STRUCTURE FOR HOIST/TRACTION APPARATUS

FIELD OF THE INVENTION

The present invention relates to a bearing structure for a hoist/traction apparatus, and more particularly to a bearing structure for supporting shafts to a gear cover covering a reduction gear mechanism of the hoist/traction apparatus.

BACKGROUND OF THE INVENTION

The bearing structure of, for example, a lever type hoist/traction apparatus, as shown in FIG. 6, is so constructed that a tubular shaft T having a load sheave is supported between a pair of side plates. Outside one side plate A a reduction gear mechanism D is disposed comprising a driving shaft S1, intermediate shafts S2, and reduction gears including a first gear G1, two second gears G2, two third gears G3, and a fourth gear G4 so as to transmit a rotary driving force of an operating lever, while being decelerated by the reduction gear mechanism D, from the tubular shaft T toward the load sheave. On the side plate A a gear cover C is mounted for covering the entire reduction gear mechanism D; and driving shaft S1 and intermediate shafts S2 are supported at one axial ends thereof to gear cover C. For supporting the driving shaft S1 and intermediate shafts S2 to the gear cover C, through-bores a and b are formed at the support portions of the shafts S1 and S2, and the axial ends of the shaft are supported in the through-bores a, b and c through bearings B1 and B2. However, in the above-mentioned support means, since the through-bores a, b and c are formed at the support portions of the shafts S1 and S2 the gear cover C respectively, a foreign objects such as water or sand, may enter into the interior from the through-bore a, b or c; or an external object may hit the bearing B1 or B2, whereby the bearing B1 or B2 may shift in position by the external force. Accordingly, a closing member H for closing the through-bores a, b and c is usually mounted to the outside of gear cover C, thereby preventing foreign objects from entering into the gear cover or the bearing B1 or B2 from shifting. In addition, in FIG. 6, the reduction gear mechanism D uses the driving shaft S1 and two intermediate shafts S2 disposed in parallel thereto, the first gear G1 is supported on the driving shaft S1, the fourth gear G4 is supported on the tubular shaft T coaxial with the driving shaft S1, and the two second gears G2, engageable with the first gear G1, and the two third gears G3, engageable with the fourth gear G4, are supported onto the intermediate shafts S2 respectively, so that the rotary driving force from the operating lever is decelerated by the gears G1, G2, G3 and G4 respectively, whereby the decelerated rotary driving force is adapted to be transmitted toward the load sheave from the fourth gear G4 through the tubular shaft T.

In the bearing structure for the above-mentioned lever type hoist/traction apparatus, in order to close the through-bores a, b and c for supporting one axial ends of the driving shaft S1 and one axial ends of intermediate shafts S2 respectively, it is required to separately mount the closing member H to the gear cover C. Hence, not only the number of parts increases, but also labor of machining the through bores a, b, and c at the gear cover C and the work of fixing the bearings B1 and B2 to the through-bores a, b and c and of mounting the closing member H to the gear cover c are extremely complicated, thereby creating the problem that necessary working efficiency is inferior and working time is quite large. Moreover, the gear cover C is subjected to a large load torque following rotation of the driving shaft S1 or each intermediate shaft S2. When the through-bores a, b and c are formed at such gear cover C, a large load torque locally acts on the portion of the respective through-bores a, b and c, such that there is a chance that these parts will be deformed. Accordingly, it is required to increase the thickness of the gear cover C to separately attach a reinforcing plate thereto for reinforcing the gear cover C.

SUMMARY OF THE INVENTION

In the light of the above-mentioned problem, the present invention has been designed. An object thereof is to provide a bearing structure for a hoist/traction apparatus, formed of swollen portions closed in section and swollen outwardly of a gear cover for covering a reduction gear mechanism at the hoist/traction appratus, whereby shafts can reliably be supported to the gear cover through bearings without the need to separately mount a closing member to the gear cover or reinforce the same by a reinforcing plate or the like as in the conventional example.

The bearing structure of the present invention for supporting intermediate shafts to the gear cover for covering a reduction gear mechanism having intermediate shafts at the hoist/traction apparatus, is characterized in that at the support portions of the gear cover for the intermediate shafts are formed swollen portions each having a blind holding portion swollen outwardly and open toward the outside axial end of each intermediate shaft, and bearings for supporting the axial ends of the shafts are fixed to the holding portions at the swollen portions, so as to support the intermediate shafts thereby.

It is preferable that at the swollen base of the respective swollen portions are provided enlarged portions each open toward the outside axial end of each intermediate shaft and also largely open with respect to the open portion of the holding portion, the enlarged portions continue thereto, and each bearing is provided with a flange to be fitted into the enlarged portion.

Each bearing mainly uses a metal bearing having an outer periphery to be fitted into the holding portion of the swollen portion and it is preferable that a diameter of the outer periphery of the bearing is made slightly larger than that of an inner periphery of the holding portion so as to fit the bearing into the swollen portion. In this case, it is preferable that the swollen base of each swollen portion is provided with a guide for guiding the bearing to the holding portion when press-fitted into the swollen portion.

As mentioned above, since the present invention is provided at the gear cover with a swollen portion having a blind holding portion, each bearing is fixed to the holding portion of the swollen portion, and each intermediate shaft is supported to the bearing. In other words, since the shafts are supported without providing the through-bores as in the conventional example, foreign objects are restrained from entering into the gear cover and the bearings are restrained from shifting without the need of separately providing the closing plate or the like at the gear cover. Moreover, since the swollen portions are blind, the supporting portions for the shafts at the gear cover are not in need of further strength. Accordingly, even without separately providing the reinforcing plate, the shafts are supported without deformation and the bearings are free from shifting, and also water or dust is prevented from entering into the gear cover. Hence, the entire structure is simplified and also the shafts are ensured to be supported to the gear cover.

When an enlarged portion open inwardly of the gear cover is provided at the base of each swollen portion through a stepped portion and each bearing is provided with a flange to be fitted into the enlarged portion, the flange is fitted into the enlarged portion to intensify strength for holding each bearing to the swollen portion, whereby each shaft can be supported further exactly and rigidly to the gear cover.

Furthermore, when the bearings are fixedly press-fitted into the swollen portions, respectively, an elastic force of a metal plate forming the gear cover is utilized to facilitate the press-fit of the bearing into the swollen portion and also after the press-fit, an elastic restoring force of the metal plate can exactly hold each bearing to the swollen portion, whereby the bearing can be held to the swollen portion with ease and rigidity.

In a case where a press-fit guide for each bearing is formed at the base of the swollen portion, each bearing is guided by the press-fit guide so as to be press-fitted into the swollen portion.

The above and further objects and novel features of the invention will more fully appear from the following detailed description when the same is read in connection with the accompanying drawings.

DETAILED DESCRIPTION OF THE INVENTION

Figure 5:
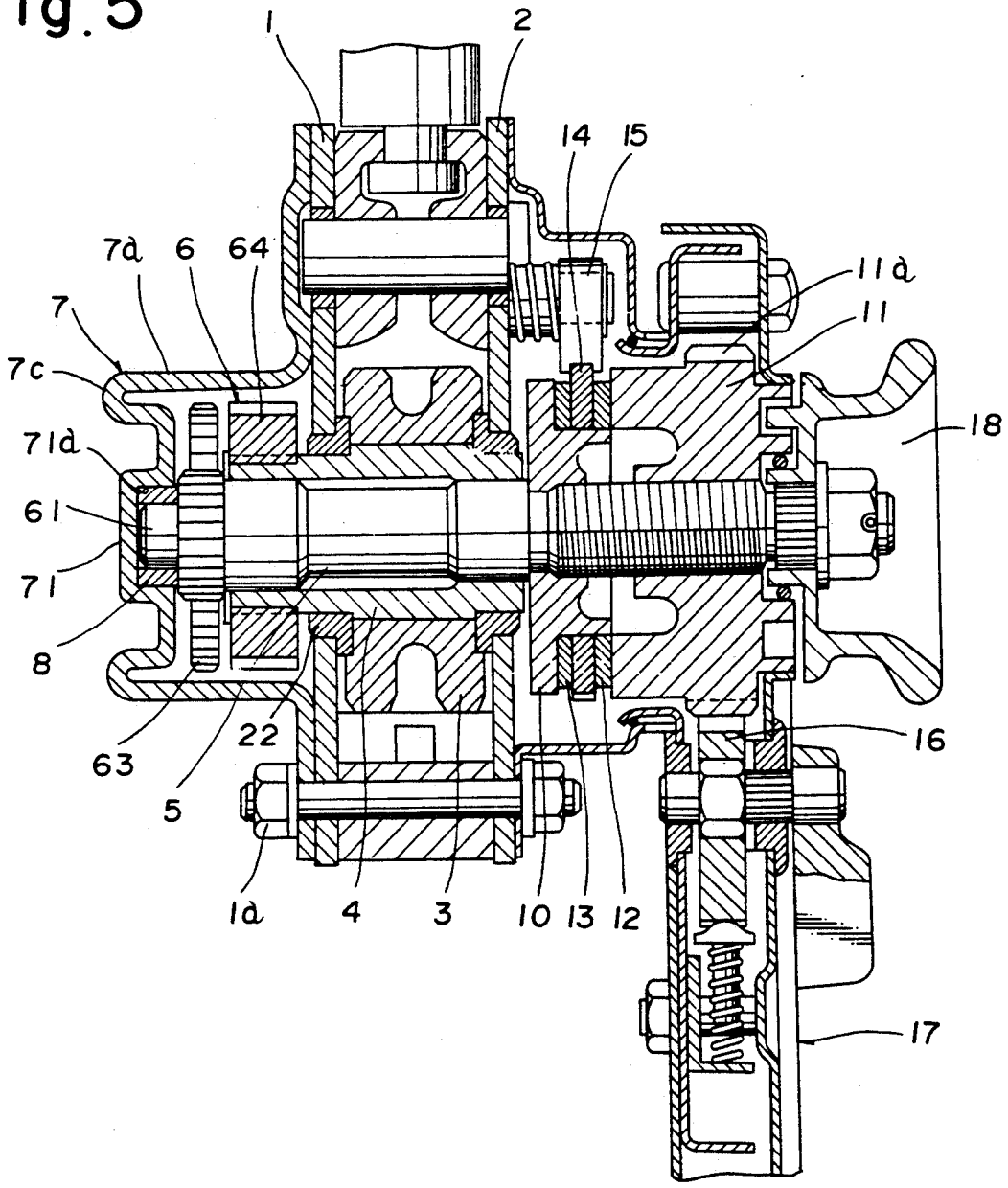
FIG. 5 is a longitudinally sectional view of the complete structure of the lever type hoist/traction apparatus.

Embodiments shown in FIGS. 1 through 5 show a bearing structure of the present invention applied to a lever type hoist/traction apparatus. The lever type hoist/traction apparatus shown in FIG. 5 is so constructed that a tubular shaft 4 having a load sheave 3 is rotatably supported between the first and second side plates 1 and 2 disposed opposite to each other and spaced at a predetermined interval. In the tubular shaft 4, a driving shaft 5 is relatively-rotatably supported to which a rotary driving force is transmitted from an operating lever to be discussed below. A reduction gear mechanism 6 is interposed into a driving force transmission system between the outside axial end of the driving shaft 5 projecting from the first side plate 1 and the tubular shaft 4. The reduction gear mechanism 6 is adapted to reduce the rotary driving force of the driving shaft 5 and transmits it toward the load sheave 3.

Figure 1:
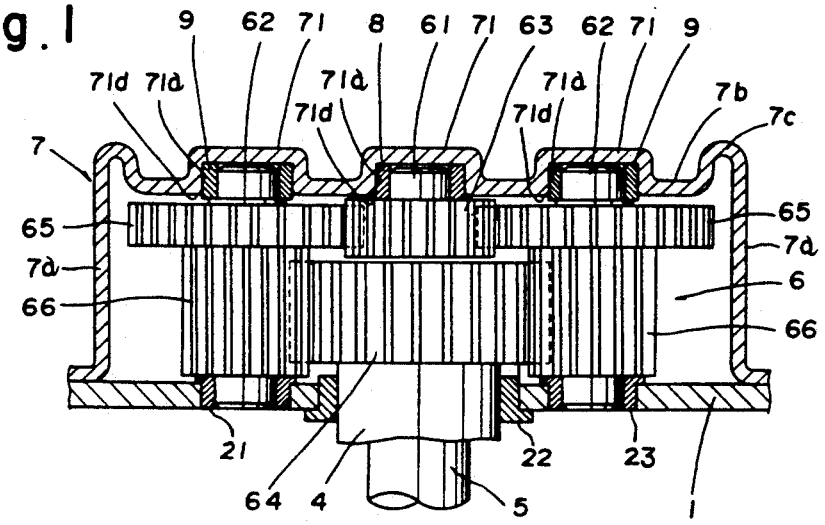
FIG. 1 is a cross-sectional view of an embodiment of bearing structure of the present invention applied to a lever type hoist/traction apparatus showing the principal portion thereof.

The reduction gear mechanism 6, as seen from FIG. 1, is provided with an extension shaft 61 extending outwardly from the driving shaft 5 and two intermediate shafts 62 parallel to the extension shaft 61. A first gear 63 is supported on the extension shaft 61, a fourth gear 64 is supported on the tubular shaft 4, and two second gears 65 engageable with the first gear 63 and two third gears 66 engageable with the fourth gear 64 respectively, are supported on the intermediate shafts 62 so that the rotary driving force of the driving shaft 5, while being reduced in a route of the first gear 63, second gears 65, third gears 66 and fourth gear 64, is transmitted from the tubular shaft 4 to the load sheave 3.

Outside the first side plate 1, a bottomed cylindrical gear cover 7 for covering the reduction gear mechanism 6 is fixed by use of a plurality of fixing bolts 1*a*. Cover 7 is integrally formed of a cylindrical wall 7*a* and an outer wall 7*b* for closing the cylindrical wall 7*a* at the outside thereof and having an opposite surface opposite to the outside axial ends of the extension shaft 61 and intermediate shafts 62. At the outside wall 7*b* of the gear cover 7, the outside axial ends of the extension shaft 61 and intermediate shafts 62 of the reduction gear mechanism 6 are journalled.

Also, as shown in FIG. 5, a hub shell 10 outside the second side plate 2 is fixed to the outside end of driving shaft 5 projecting from the plate 2. A feed gear 11 screws with the driving shaft 5 outside the hub shell 10. A pair of brake plates 12 and 13 and a braking ratchet wheel 14 are interposed between the hub shell 10 and the feed gear 11. At the second side plate 2, an anti-reverse-rotation pawl 15 engageable with the ratchet wheel 14 is provided to restrain reverse rotation thereof. At the outer peripheral portion of feed gear 11, an operating lever 17 is supported having a pawl 16 engageable with teeth 11*a* of the feed gear 11 and changeable between normal and reverse rotations, and outside the feed gear 11 is provided a feed handle 18.

Thus, the operating lever 17 is operated in reciprocation to normally or reversely rotate the feed gear 11. When normally rotated, the feed gear 11 screws forward to integrate the feed gear 11, brake plates 12 and 13, and racthet wheel 14, and a rotary driving force of feed gear 11 is transmitted to the load sheave 3 from the driving shaft 5 through the reduction gear mechanism 6 and tubular shaft 4. A load chain engaged with the outer periphery of the load sheave 3 is rotated following rotation thereof to thereby hoist or haul a load. When, the feed gear 11 is reversely rotated by the lever 17, the driving shaft 5 is reversely rotated only by an amount of reverse rotation of the feed gear 11, thereby performing unloading, or releasing traction.

Figure 2:
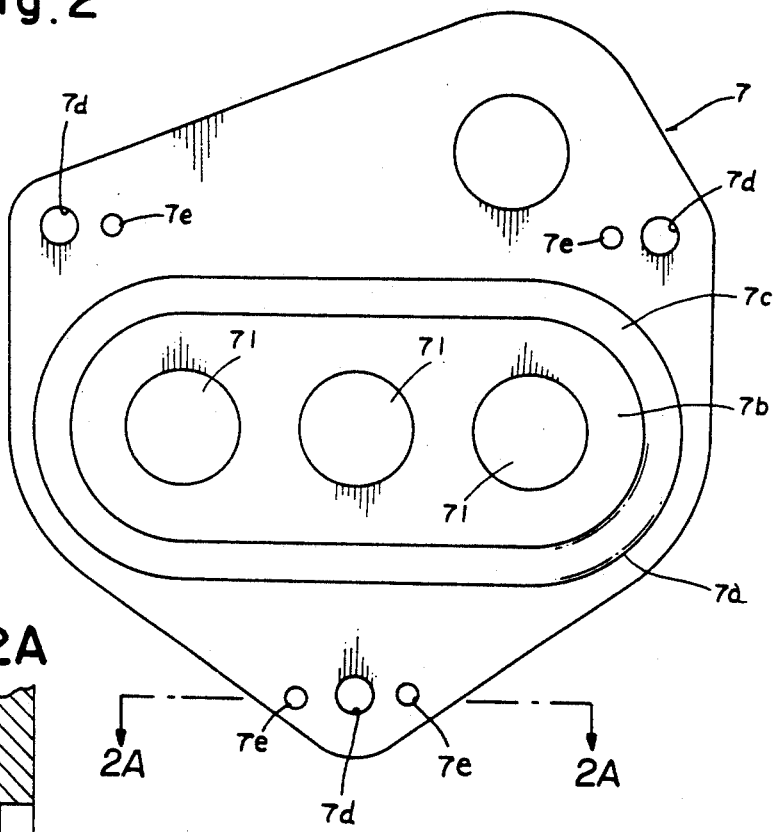
FIG. 2 is a front view of a gear cover thereof.
Figure 2A:
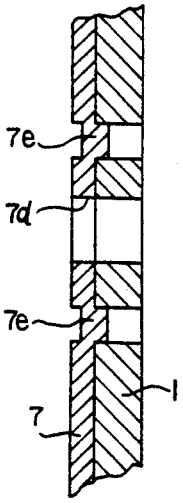
FIG. 2(A) is a cross-sectional view of the gear cover of FIG. 2, FIGS. 3 and 4 show other modified embodiments of the invention.

The bearing structure at the lever type hoist/traction apparatus of the present invention, which supports one axial ends of the extension shaft 61 and intermediate shafts 62 to the gear lover 7, is constructed as follows:

As shown in FIGS. 1 and 2, at the outer wall 7*b* of the gear cover 7 and at the supporting portions thereof for the extension shaft 61 and intermediate shafts 62, the three blind cylindrical swollen portions 71, each outwardly swollen and open toward the outside axial end of each shaft, are independently and integrally provided. First bearing 8 for supporting the outside axial end of the extension shaft 61 and second bearings 9 for supporting the outside axial ends of the intermediate shafts 62 respectively are fixedly press-fitted into blind holding portions 71*a* formed at the swollen portions 71.

Bearings 8 and 9 rotatably support the shafts 61 and 62 to the gear cover 7.

In the embodiment shown in FIGS. 1 and 2, a reinforcing rib 7c projecting in the same direction as the swollen portions 71 is circumferentially formed at a blind portion through which the cylindrical wall 7a and the outside wall 7b are continued, thereby intensifying the entire strength of the gear cover 7 by means of the reinforcing rib 7c. In this case, as seen from FIG. 1, it is preferable that the reinforcing rib 7c outwardly projects higher than the respective swollen portions 71. Hence, when the hoist/traction apparatus is installed on the ground keeping the gear cover 7 below during the hoisting work or the like, the reinforcing rib 7c restrains each swollen portion 71 from coming into direct contact with the ground, thereby preventing each swollen portion 71 from being damaged or deformed. Also, through-bores 7d for the bolts 1a are provided at the gear cover 7, through which the cover 7 is fixed to the first side plate 1 and a plurality of knock pins 7e to be fitted into windows (not shown) provided at the first side plate 1, the knock pins 7e being fitted into the windows to position the swollen portions 71, thereby improving bearing precision between the bearings 8 and 9 fixed to the swollen portions 71 and those 21, 22 and 23 supported to the first side plate 1.

Next, explanation will be given on a manufacutring method for the bearing structure for supporting the extension shaft 61 and intermediate shafts 62 to the gear cover 7 of the lever type hoist/traction apparatus.

At first, the gear cover 7 is formed of a thin metal plate and cold-plastic-processed by press work or the like to mold the cylindrical wall 7a and outside wall 7b, at which time at the supporting portions of the extension shaft 61 and intermediate shafts 62 at the gear cover 7 are simultaneously molded the blind swollen portions 71 cold-plastic-processed and swollen outwardly after submitted to the cold-plastic-processing.

In this case, an inner diameter of each holding portion 71a formed in each swollen portion 71 is made slightly smaller than an outer diameter of each first or second bearing 8 or 9 fixed to each holding portion 71a. The first bearing 8 for supporting the driving shaft 61 and the second bearings 9 for supporting the intermediate shafts 62 respectively are press-fitted in the holding portions 71a at the swollen portions 71 from the interior of cover 7 and fixed thereto. By this bearing structure manufacturing method, the swollen portions 71 which are molded by cold-plastic-processing the metal plate when the gear cover 7 is molded, can be molded with ease and accuracy, and the elastic force of the metal plate is utilized to facilitate the press-fit of the first and second bearings 8 and 9 into the swollen portions 71, respectively when the first and second bearings 8 and 9 are press-fitted and fixed into the respective swollen portions. After the press-fit, an elastic restoring force of the metal plate reliably holds the first and second bearings 8 and 9 at the swollen portions 71, respectively.

As shown in FIG. 1, when a round press-fit guide 71d for guiding each bearing 8 or 9 to the holding portion 71a is formed at the swollen base of each swollen portion 71, each bearing 8 or 9, when press-fitted into each swollen portion 71, is guided by the press-fit guide 71d and press-fitted into the swollen portion 71 with ease.

The bearing structure of the present invention supports the axial ends of the extension shaft 61 and intermediate shafts 62 through the first and second bearings 8 and 9 to the respective swollen portions 71 of closing construction in section and integrally formed with the outside wall 7b at the gear cover 7, thereby preventing a foreign object from entering therein from the exterior or the first and second bearings 8 and 9 from shifting by an external force without separately providing a closing plate or the like at the gear cover 7 as in the conventional art. Also, since each swollen portion 71 is closed in section and integral with the outside wall 7b, the supporting portions at the gear cover 7 for the shafts 61 and 62 are not in need of further strength, whereby there is no need of separately adding the reinforcing plate or the like. Hence, the gear cover 7 only can ensure proper support of the shafts 61 and 62.

Figure 3:
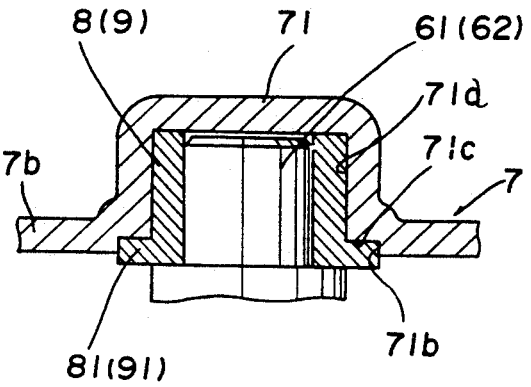

A modified embodiment of the swollen portion 71 at the gear cover 7 and first and second bearings 8 and 9 is shown in FIG. 3, in which an enlarged portion 71b, larger in diameter than the holding portion 71a and recessed in a predetermined depth, is formed at the inner periphery of the outside wall 7b and at the swollen base of each swollen portion 71. The enlarged portion 71b is a continuation of the holding portion 71a at each swollen portion 71 through a circumferentially flat stepped portion 71c. At the first or second bearing 8 or 9, a flange 81 or 91 capable of being fitted into the enlarged portion 71b is formed integrally therewith.

When the first and second bearings 8 and 9 are fixedly press-fitted into the holding portions 71a at the swollen portion 71, the flanges 81 and 91 at the bearings 8 and 9, while abutting at the outside surfaces against the stepped portions 71, are fitted into the enlarged portions 71 respectively, so that the holding strengths of bearings 8 and 9 with respect to each swollen portioon 71 are intensified. Especially, the extension shaft 61 and intermediate shafts 62 each are subjected to a large load torque following rotation thereof, and such load torque is received by the insertion portion of each bearing 8 or 9 into each support bore 71a and the fitted portion of each flange 81 or 91 into each enlarged portion 71b, whereby each bearing 8 or 9 can exactly and rigidly supports the respective extension shaft 61 and intermediate shafts 62 to the gear cover 7.

The enlarged portions 71b and stepped portions 71c are molded simultaneously with the swollen portions 71 by cold-plastic-working. Moreover, since the enlarged portions 71b and stepped portions 71c are recessed to be molded during the cold-plastic working, the enlarged portions 71b and stepped portions 71c can obtain perpedicularity with ease, thereby being formed with accuracy. Therefore, the flanges 81 and 91 can exactly be fitted into the enlarged portions 71b, thereby enabling the holding strengths of bearings 8 and 9 with respect to the swollen portions 71 to be intensified.

Figure 4:
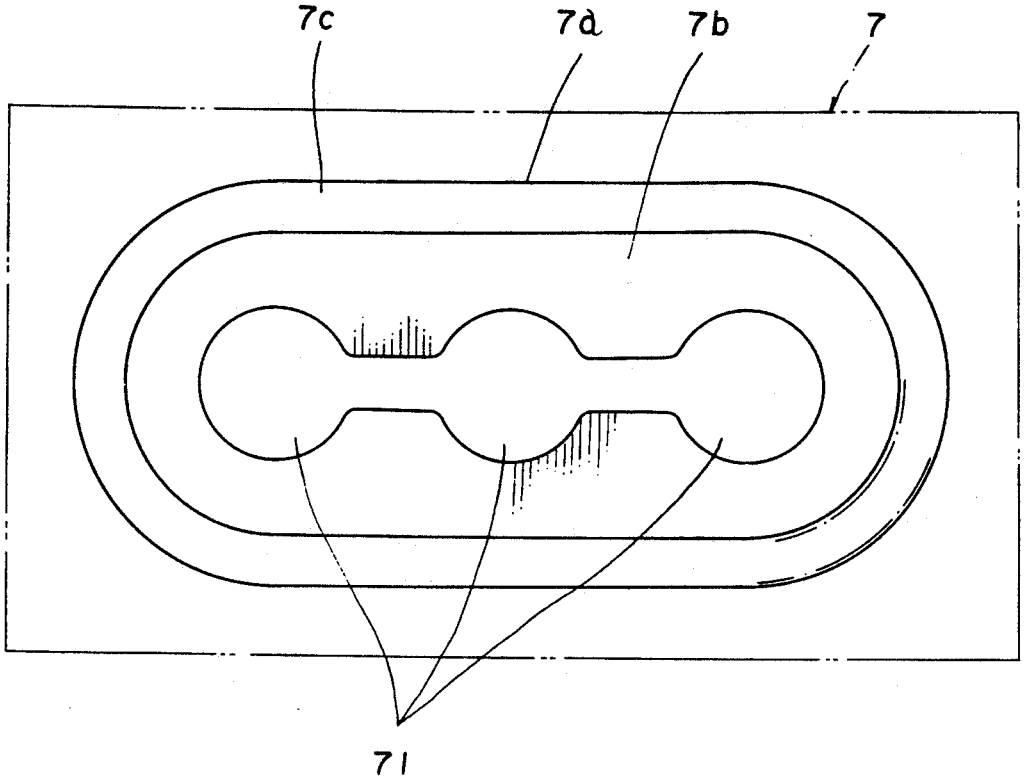
Figure 6:
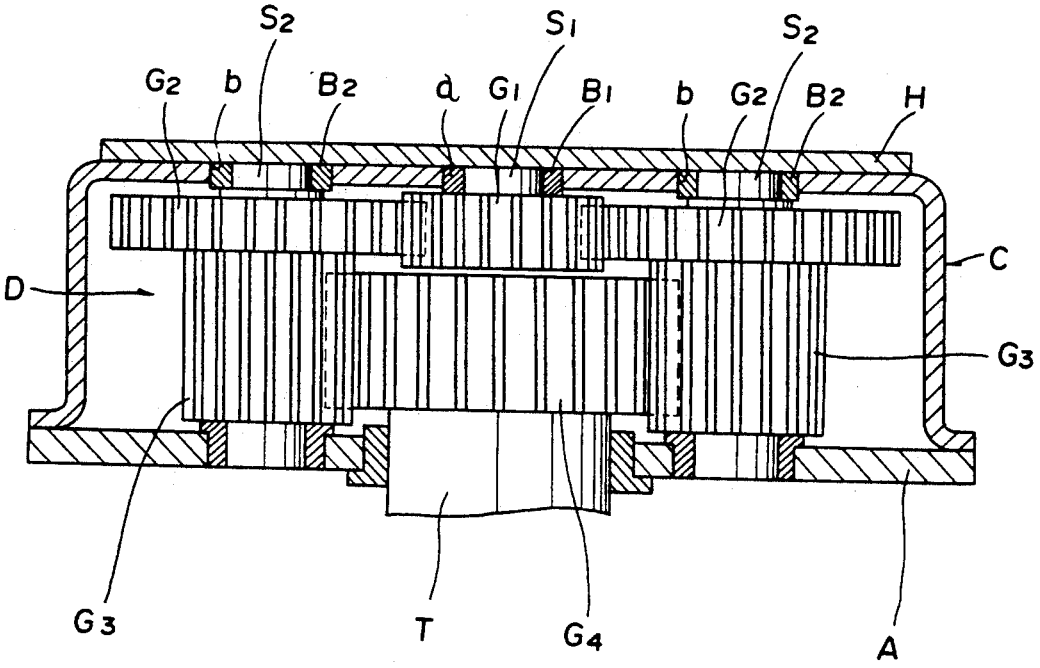
Fig. 6 (PRIOR ART)
FIG. 6 is a sectional view of the conventional example thereof.

Alternatively, the swollen portions at the gear cover 7 may be formed continuously as shown in FIG. 4.

Alternatively, the extension shaft 61, which is supported to the first and second side plates 1 and 2, is not inevitably supported at the other axial end to the gear cover 7, so that the intermediate shafts 62 only may be supported at the axial ends thereof to the gear cover 7.

Furthermore, in the above-mentioned embodiments, the bearing structure applied to the lever type hoist/-traction apparatus are described, which of course is applicable to a hoist apparatus, such as a chain block, or a traction apparatus.

As seen from the above, the bearing structure for the hoist/traction apparatus of the present invention forms at the support portions of the shafts at the gear cover 7 the swollen portions 71 swollen outwardly and closed in section, and fixes within the swollen portions 71 the bearings for supporting the axial ends of the shafts, whereby the shafts can be supported through the bearings into the swollen portions 71 closed in section. As the result, there is no need for separately providing at the gear cover 7 the closing plate or reinforcing plate as in the conventional example, so that the entire construction is simplified and also entry of the forein object or shifting of the bearing, can be prevented. Moreover, since the swollen portions 71, each closed in section, does not negate the strength of each shaft supporting portion, the gear cover 7 can exactly support the bearings.

Also, in the case where the enlarged portion 71 open inwardly of the gear cover 7 is provided at the swollen base of each swollen portion 71 through the stepped portion 71*c* and the flanges to be fitted into the enlarged portions 71*b* are provided at the bearings respectively, the flanges are fitted into the enlarged portions 71*b* to thereby intensify the holding strength of bearing with respect to each swollen portion 71 and exactly support the shafts to the gear cover 7.

Furthermore, the manufacturing method for the bearing structure at the hoist/traction apparatus of the present invention is that during the molding the gear cover 7 by cold-plastic-working, the swollen portions 71, each outwardly swelling and closed in section, are molded at the shaft supporting portions by the cold-plastic-working, and thereafter the bearing for supporting the axial end of each shaft is fixedly fitted into the cover 7 from the inside thereof, so that, when the gear cover 7 is molded of metal plate by the cold-plastic-working, each swollen portion 71 can be molded with ease. Also, when the bearing is fixedly press-fitted into each swollen portion 71, the elastic force of the metal plate is utilized to facilitate the press-fit of bearing to each swollen portion 71, and, after the press-fit, the elastic restoring force of metal plate can reliably hold the bearing to each swollen portion 71.

When the press-fit guide 71*d* for the bearing is formed at the swollen base of each swollen portion 71, the axial end of the bearing is guided by the press-fit guide 71*d* during the press-fit of bearing into each swollen portion 71, whereby the bearing can be press-fitted into each swollen portion 71 with ease.

Although several embodiments have been described, they are merely exemplary of the invention and not to be constructed as limiting, the invention being defined solely by the appended claims.

What is claimed is:

1. A hoist/traction apparatus comprising:

(a) a load sheave;

(b) a driving shaft for driving said load sheave;

(c) a gear reduction mechanism, including intermediate shafts, interposed in a transmission system between said driving shaft and said load sheave; and (d) a gear cover, pressed from sheet metal, covering said gear reduction mechanism, said gear cover comprising (d-1) a cylindrical wall, having a top and a bottom, enclosing said gear reduction mechanism;

(d-2) an outer wall, having a inward side facing said gear mechanism and an outward side, said outer wall closing said top of said cylindrical wall;

(d-3) a plurality of blind swollen portions formed on said outer wall and protruding outwardly, said plurality of blind swollen portions including support portions for supporting said intermediate shafts and said driving shaft; and (d-4) a reinforcing rib, linking said cylindrical wall to said outer wall, projecting in the same outward direction as said blind swollen portions and encircling said blind swollen portions;

wherein bearings for supporting outer axial ends of said intermediate shafts and said driving shaft are fitted in and held within said holding portions of said blind swollen portions.

2. A hoist/traction apparatus according to claim 7, wherein a swollen base of each of said swollen portions has an enlarged portion open toward said outer axial ends of each of said intermediate shafts, said enlarged portion being a continuation of said holding portion through a stepped portion, and said bearings fitted into each of said holding portions being provided with a flange fitted into said enlarged portion.

3. A hoist/traction apparatus according to claim 7, wherein said bearings each have an outer periphery fitted into said holding portion of each of said swollen portions, and a diameter of said outer periphery is slightly larger than an inner periphery of said holding portion, whereby said bearings are fitted into said swollen portion by press-fit.

4. A hoist/traction apparatus according to claim 3, wherein a swollen base of each of swollen portions is provided with a guide for guiding said bearings into said holding portion.

5. A hoist/traction apparatus according to claim 7, wherein said reinforcing rib projects higher than said swollen portions.

6. A hoist/traction apparatus according to claim 7, wherein said gear cover is provided with a plurality of knock pins for positioning said gear cover.

7. A hoist/traction apparatus according to claim 1, wherein said reinforcing rib projects at least as high as said swollen portions.

* * * * *